US008143545B2

(12) United States Patent
Zuo

(10) Patent No.: US 8,143,545 B2
(45) Date of Patent: Mar. 27, 2012

(54) SLIDING BUTTON MECHANISM

(75) Inventor: Zhou-Quan Zuo, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 356 days.

(21) Appl. No.: 12/561,366

(22) Filed: Sep. 17, 2009

(65) Prior Publication Data

US 2010/0155215 A1 Jun. 24, 2010

(30) Foreign Application Priority Data

Dec. 23, 2008 (CN) ..... 2008 1 0306484

(51) Int. Cl.
*H01H 15/10* (2006.01)

(52) U.S. Cl. ..... 200/547; 200/536

(58) Field of Classification Search ..... 200/252, 200/536, 547–550, 562, 563
See application file for complete search history.

(56) References Cited

U.S. PATENT DOCUMENTS 4,983,795 A * 1/1991 Suzuki ..... 200/550
6,313,420 B1 * 11/2001 Ohashi ..... 200/302.1

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A sliding button mechanism includes a housing, a button, a connecting member, two resilient elements, and a printed circuit board. The housing defines a sliding slot. The button is slidably received in the sliding slot. The connecting member is secured on the button. Two resilient elements are disposed between the housing and the button provides a resilient force to the button. The printed circuit board is secured in the housing and includes at least two contact areas. The connecting member continuously and simultaneously connects to the two contact areas to achieve a continuous adjustment function.

17 Claims, 4 Drawing Sheets

SLIDING BUTTON MECHANISM

BACKGROUND

1. Technical Field

The present disclosure relates to sliding button mechanisms, and particularly to a sliding button mechanism used in a portable electronic device.

2. Description of Related Art

With the development of technology, many portable electronic devices (e.g., mobile phones and personal digital assistants) are designed to be multifunctional. For example, a mobile phone can also have the functions of capturing photos, receiving broadcasts, etc. In use, these multifunctional portable electronic devices can be switched into different working modes corresponding to these functions by sliding button mechanisms.

In many conventional sliding button mechanisms, the buttons are usually not in tight contact with the housings. Thus, portable electronic devices using these sliding button mechanisms have assembling clearances formed between their housings and the buttons, which unfortunately may allow contaminants to enter the device and cause problems. Moreover, the sliding button can control volume and etc. of the portable electronic devices. When the volume is turned up or down, the button must be continuously slid towards one direction in a sliding slot of the portable electronic devices. However, the sliding slot usually has a longer length so as to greatly affect the appearance of the portable electronic devices.

Therefore, there is a room for improvement within the art.

BRIEF DESCRIPTION OF THE DRAWINGS

Many aspects of a sliding button mechanism can be better understood with reference to the following drawings. The components in the drawings are not necessarily to scale, the emphasis instead being placed upon clearly illustrating the principles of the sliding button mechanism. Moreover, in the drawings, like reference numerals designate corresponding parts throughout the several views.

DETAILED DESCRIPTION OF THE EMBODIMENTS

Figure 1:
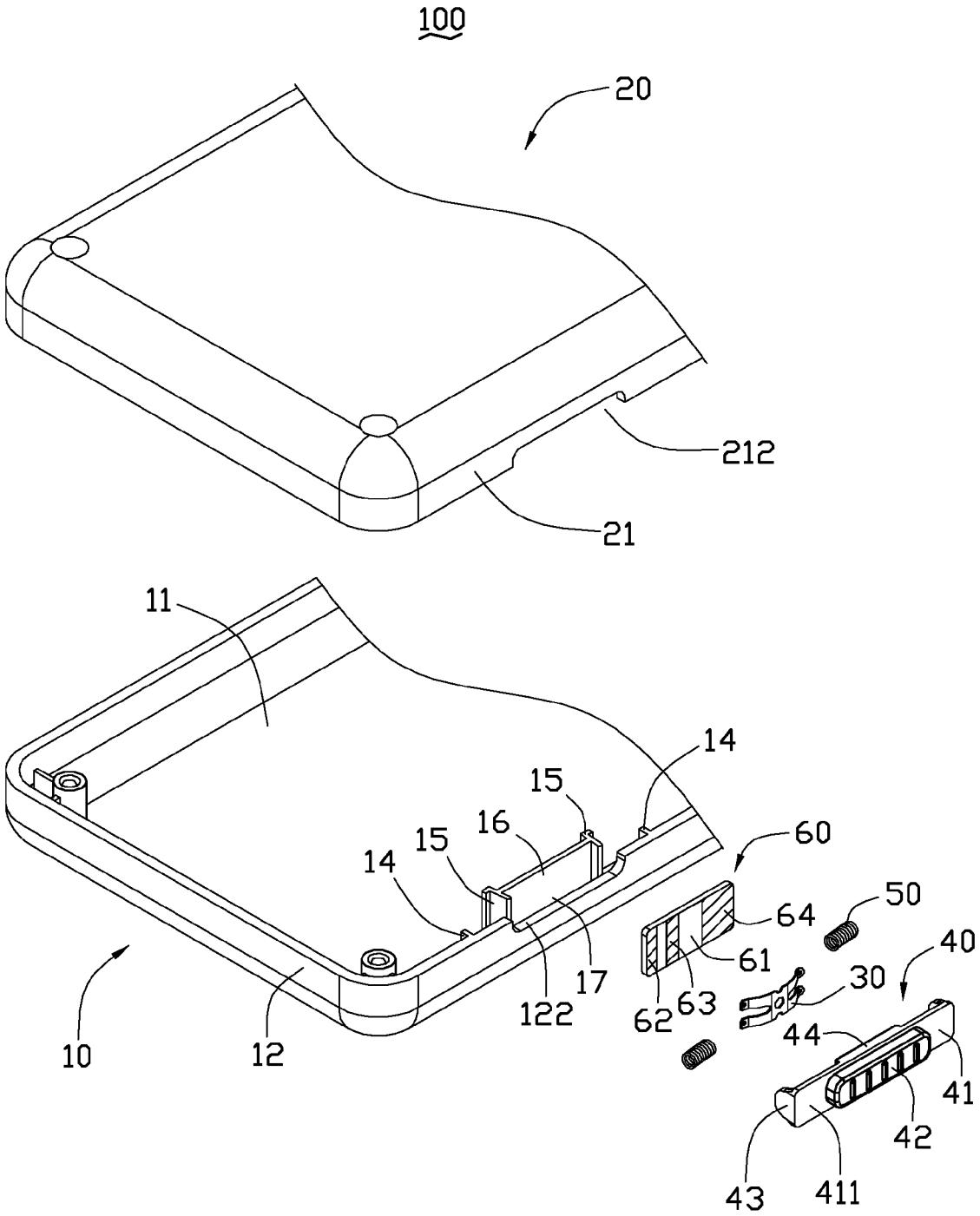
FIG. 1 is an exploded, partial isometric view of a sliding button mechanism, according to an exemplary embodiment.
Figure 2:
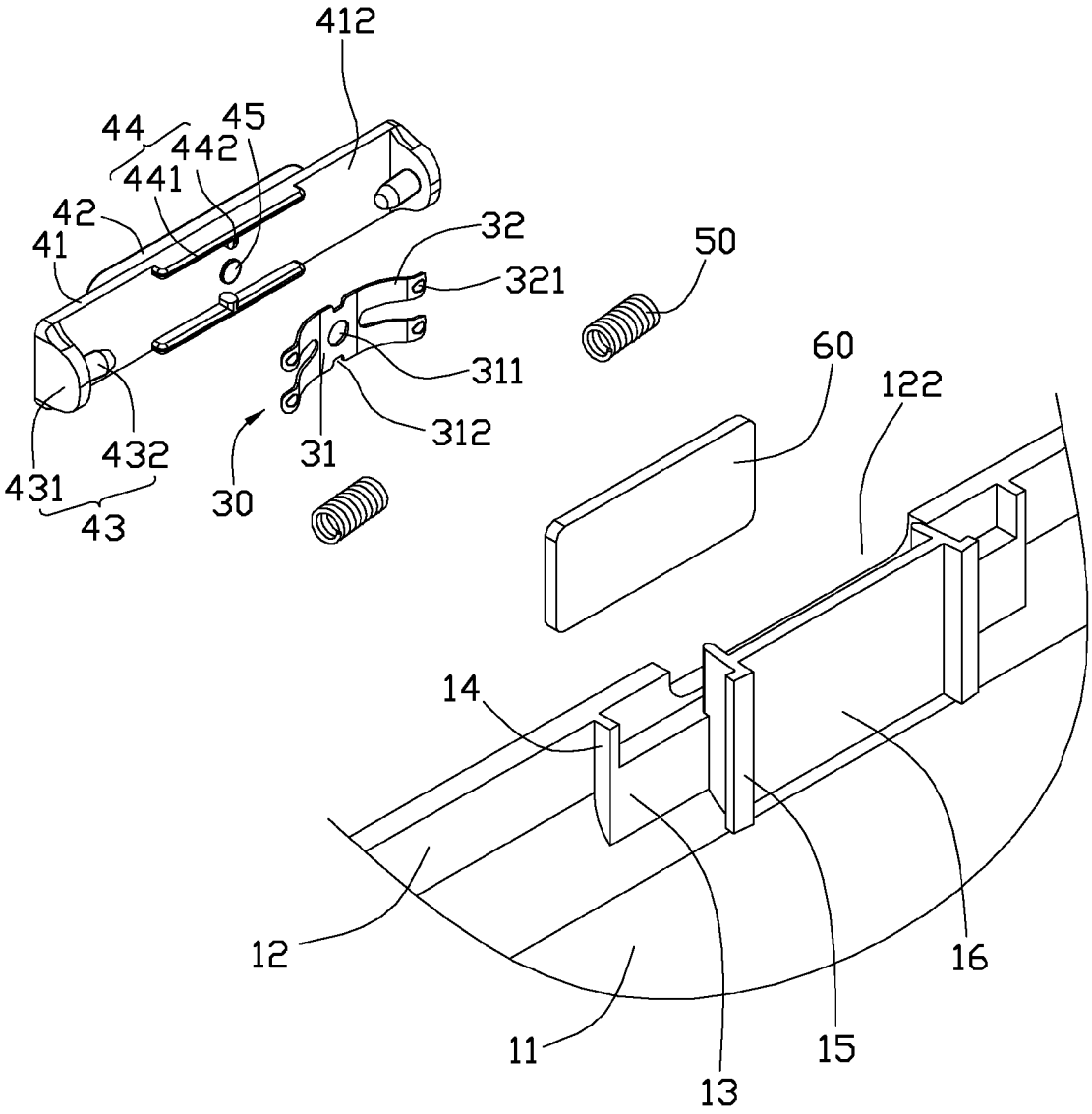
FIG. 2 is similar to FIG. 1, but viewed from anther angle.
Figure 3:
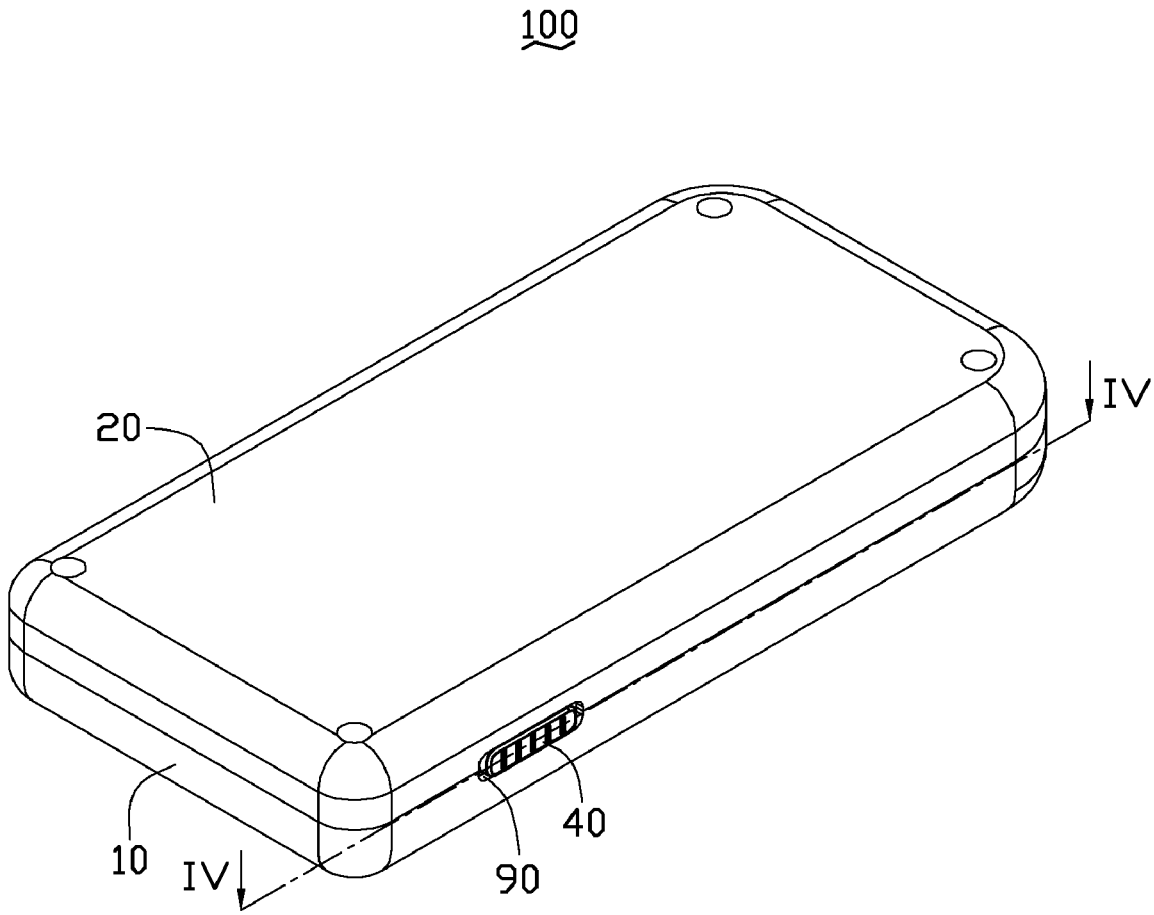
FIG. 3 is an assembled, isometric view of the sliding button mechanism.

Referring to the drawings, FIG. 1 to FIG. 3 show a sliding button mechanism 100 applied in a portable electronic device. The sliding button mechanism 100 includes a first housing 10, a second housing 20 corresponding the first housing 10, a connecting member 30, a button 40, two resilient elements 50, and a printed circuit board (PCB) 60.

The first housing 10 includes a first bottom wall 11 and a first peripheral wall 12 perpendicular to the bottom wall 11. The first peripheral wall 12 defines a first opening 122. The first housing 10 further includes two supporting portions 13, two stopping plates 14, two resisting plates 15, and a limiting plate 16. The two supporting portions 13 protrude from an interior surface of the first peripheral wall 12, and are symmetrically positioned at opposite sides of the first opening 122. The two stopping plates 14 perpendicularly extend from the supporting portions 13. The two resisting plates 15 extend from the bottom wall 11 adjacent to the first opening 122. Each of the resisting plates 15 connects to an end of supporting portions 13. The resisting plates 15 are L-shaped and face each other. Each of the resisting plates 15 slightly leans toward the first peripheral wall 12. The limiting plate 16 connects to the two resisting plates 15. The limiting plate 16, the first peripheral wall 12, and two resisting plates 15 cooperatively defines a receiving slot 17 for accommodating the printed circuit board 60.

The second housing 20 has a shape corresponding to the first housing 10 so as to attach to the first housing 10. The second housing 20 includes a second peripheral wall 21 defining a second opening 212 corresponding to the first opening 122.

The connecting member 30 is made of conductive elastic materials. The connecting member 30 includes a main section 31 and a plurality of arms 32. The main section 31 defines a through hole 311 and two notches 312. The through hole 311 is defined in a central portion of the main section 31. The two notches 312 are defined in opposite sides of the main section 31 correspondingly. Each of the arms 32 symmetrically extends from opposite sides of the main section 31 correspondingly. The arms 32 are all bent to a same side of the main section 31, thereby the connecting member 30 has a curved shape. Each of the arms 32 has a protrusion 321 formed on a distal end thereof. In the exemplary embodiment, there are four arms 32.

The button 40 includes a main portion 41, an operating portion 42, two latching portions 43, two clasp portions 44, and a projection 45. The main portion 41 includes a first surface 411 and a second surface 412 opposite to the first surface 411. The operating portion 42 protrudes from a center of the first surface 411. Each of the latching portions 43 includes a latching board 431 and a post 432. Each latching board 431 perpendicularly extends from two ends of the main portion 41. Each post 432 protrudes from the latching board 431, slightly leaning away from the main portion 41. Therefore, the resilient elements 50 are disposed between the latching board 431 and the resisting plate 15 presses the button 40 to tightly abut against the interior surface of the peripheral wall 12, thus avoid exposing a predetermined sliding space of the button 40. The two clasp portions 44 symmetrically extend from opposite peripheral edges of the first surface 411. Each of clasp portions 44 includes a latching bar 441 and a latching block 442 perpendicularly extending from a middle of the latching bar 441. The projection 45 corresponding to the through hole 311 is positioned on a central portion of the second surface 412.

The resilient elements 50 is sleeved on the posts 432 correspondingly, and are disposed between the resisting plate 15 and the latching board 431 for providing a resilient force to the button 40.

The printed circuit board 60 is a part of the inner circuitry of the portable electronic device. The printed circuit board 60 includes a main body 61, a first contact area 62, a second contact area 63, and a third contact area 64 separately formed on a surface of the main body 61. When the third contact area 64 and the first contact area 62 are conducted to each other, the portable electronic device performs a function, such as turning up volume of the portable electronic device. Accordingly, when the third contact area 64 and the second contact area 63 are conducted, the portable electronic device achieves the other function, such as turning down volume of the portable electronic device.

Referring to FIG. 3, in assembly, the printed circuit board 60 is placed and secured in the receiving slot 17. The projection 45 is inserted into the through hole 311, and each latching block 442 engages with the notches 312, thus the connecting member 30 is mounted to the button 30. Each protrusion 321 is pressed to be in contact with the main body 61. Each of the resilient elements 50 coils around corresponding post 432 and disposed between the resisting plate 15 and the latching board 431. The main portion 41 latches to the supporting portions 13. The operating portion 42 is received in the first opening 212. The second housing 20 is assembled on the first housing 10 to form a sliding slot 90 by the first opening 122 and the second opening 212. The button 40 is slidably assembled in the sliding slot 90.

Figure 4:
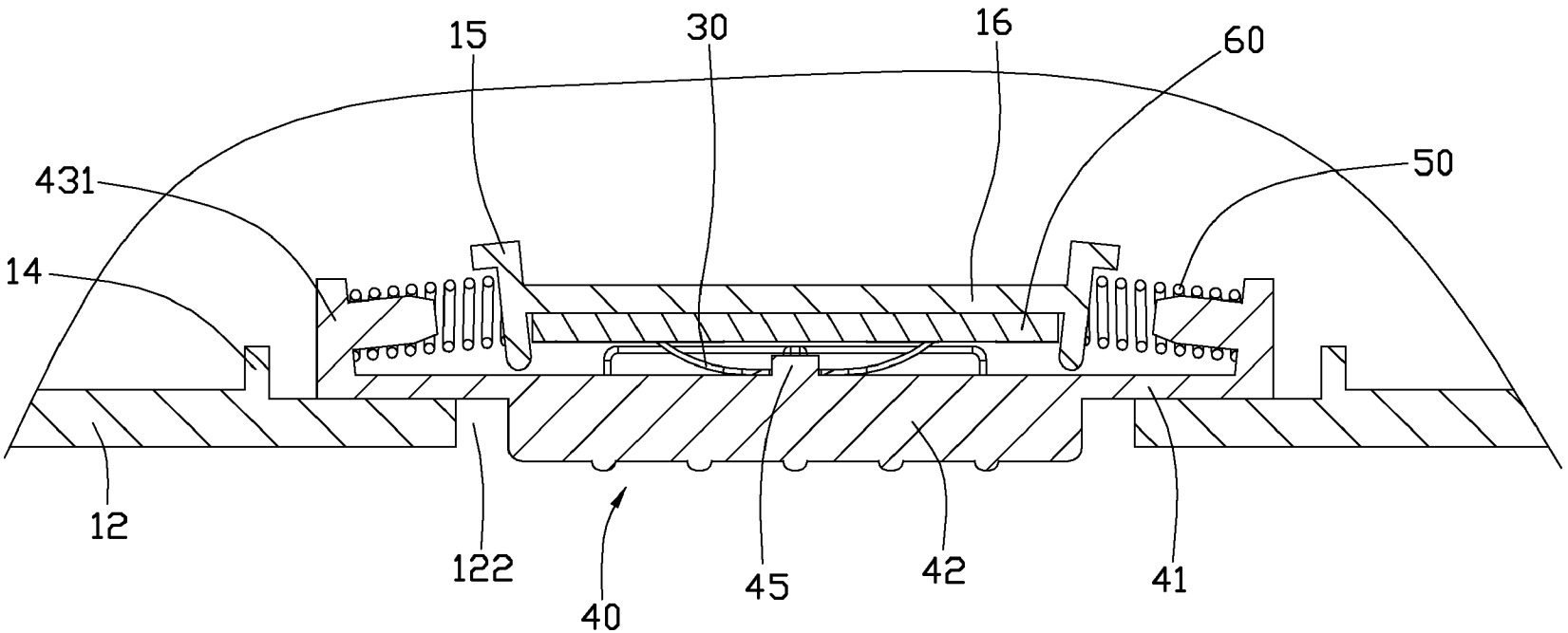
FIG. 4 is a cross-sectional view taken along line IV-IV of FIG. 3.

Referring to FIG. 4, to turn up the volume of the portable electronic device, the operating portion 42 is slid along the sliding slot 90 by an external force. As a result, one of the resilient elements 50 becomes compressed. One of the latching portions 43 resists corresponding stopping plate 14. Accordingly, the button 40 and the connecting member 30 are driven to slide relative to the printed circuit board 60 by the external force. The connecting member 30 simultaneously contacts with the third contact area 64 and the first contact area 62, and, thus, the portable electronic device performs a function, such as turning up the volume of the portable electronic device. When the external force is removed, the button 40 slides backward and returns its original position by a resilient force of one of the resilient elements 50. Thus, each protrusion 321 of the connecting member 30 contacts with the main body 61. Accordingly, the third contact area 64 and the first contact area 62 are shut off. Therefore, the volume of the portable electronic device is kept constant. When the operating portion 42 is pushed by the same external force again, the connecting member 30 contacts with the third contact area 64 and the first contact area 62 one more time, the volume of the portable electronic device is continuously turned up.

Conversely, when the button 40 is pushed by an opposite external force, the connecting member 30 simultaneously contacts with the third contact area 64 and the second contact area 63, the volume of the portable electronic device is turned down.

The sliding button mechanism 100 includes two resilient elements 50 sleevable on the post 432 and the resisting plate 15. The post 432 and the resisting plate 15 are tilted. Therefore, the resilient elements 50 are disposed between the latching board 431 and the resisting plate 15 can compress the button 40 to tightly abut against the interior surface of the peripheral wall 12, thus efficiently avoid exposing a predetermined sliding space of the button 40. Furthermore, the connecting member 30 can continuously and simultaneously contact with two contact areas, the printed circuit board 60 can achieve a continuous adjustment function.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sliding button mechanism, comprising:

a housing including two resisting plates and a sliding slot;

a button slidably received in the sliding slot, the button including a main portion and two latching portions positioned on two ends of the main portion;

a connecting member secured on the main portion of the button;

two resilient elements disposed between the resisting plates of the housing and the latching portions of the button, and providing a resilient force to the button; and a printed circuit board secured in the housing and including at least two contact areas;

wherein the connecting member can connect the two contact areas to achieve a continuous adjustment function.

2. The sliding button mechanism as claimed in claim 1, wherein the connecting member includes a main section defining a through hole and forming arms extending from the main section, and the button includes a projection inserted into the through hole.

3. The sliding button mechanism as claimed in claim 2, wherein the printed circuit board includes a main body, a first contact area, a second contact area, and a third contact area separately formed on the main body, the connecting member contacts with the first contact area and the third contact area to achieve one function, and the connecting member contacts with the second contact area and the third contact area to achieve another function.

4. The sliding button mechanism as claimed in claim 3, wherein the button further comprises at least one clasp portion including a latching bar and a latching block perpendicularly extending from the latching bar, and the main section defines at least one notch matching with the latching block.

5. The sliding button mechanism as claimed in claim 1, wherein the housing includes a bottom wall, a peripheral wall perpendicular to the bottom wall, and the resisting plates extending from the bottom wall.

6. The sliding button mechanism as claimed in claim 5, wherein each of the resisting plates slightly leans toward the peripheral wall.

7. The sliding button mechanism as claimed in claim 6, wherein the housing further includes a limiting plate connecting to the resisting plates, the limiting plate, the first peripheral wall, and two resisting plates cooperatively define a receiving slot for accommodating the printed circuit board.

8. The sliding button mechanism as claimed in claim 5, wherein each of the latching portions includes a latching board and a post, each latching board perpendicularly extends from two ends of the main portion, each post protrudes from the corresponding latching board, slightly leaning away from the main portion.

9. The sliding button mechanism as claimed in claim 8, wherein the housing further includes two supporting portions protruding from the peripheral wall and two stopping plates respectively perpendicularly extending from the supporting portions, the latching portions resist corresponding stopping plates when the button slides in the sliding slot.

10. A sliding button mechanism comprising:

a housing including a bottom wall, a peripheral wall perpendicular to the bottom wall, and two resisting plates extending from the bottom wall, the peripheral wall defining a sliding slot, each of the resisting plates slightly leans toward the peripheral wall;

a button slidably received in the sliding slot; and two resilient elements disposed between the each of the resisting plates and the button providing resilient force to the button.

11. The sliding button mechanism as claimed in claim 10, wherein the button includes a main portion and two latching portions respectively extending from two ends of the main portion, each of the latching portions includes a latching board and a post protruding from the latching board, each post slightly leaning away from the main portion.

12. The sliding button mechanism as claimed in claim 11, wherein the resilient elements are respectively disposed between the latching board and the resisting plate.

13. The sliding button mechanism as claimed in claim 12, further comprises a connecting member secured on the button and a printed circuit board secured in the housing, the connecting member resists the printed circuit board.

14. The sliding button mechanism as claimed in claim 13, wherein the printed circuit board includes a main body, a first contact area, a second contact area, and a third contact area separately formed on the main body, the connecting member contacts with the first contact area and the third contact area to achieve one function, the connecting member contacts with the second contact area and the third contact area to achieve another function.

15. The sliding button mechanism as claimed in claim 14, wherein the connecting member includes a main section defining a through hole and arms extending from the main section, and the button includes a projection inserted into the through hole.

16. The sliding button mechanism as claimed in claim 15, wherein the button further comprises at least one clasp portion including a latching bar and a latching block perpendicularly extending from the latching bar, and the main section defines at least one notch matching with the latching block.

17. The sliding button mechanism as claimed in claim 16, wherein the housing further includes a limiting plate connecting to the resisting plates, the limiting plate, the first peripheral wall, and two resisting plates cooperatively define a receiving slot for accommodating the printed circuit board.

* * * * *